US005485661A

United States Patent [19]

McClure

[11] Patent Number: 5,485,661

[45] Date of Patent: Jan. 23, 1996

[54] ENVIRONMENTALLY-PROTECTIVE COMBINATION BURIAL/SHIPPING/CREMATION CASE

[76] Inventor: Wilbur F. McClure, 973 Meadow La., Troy, Ohio 45373

[21] Appl. No.: 88,726

[22] Filed: Jul. 9, 1993

[51] Int. Cl.[6] ..... A61G 21/00

[52] U.S. Cl. ..... 27/7; 27/17; 27/35

[58] Field of Search ..... 27/2, 3, 7, 35, 27/17; 206/596, 698, 386

[56] References Cited

U.S. PATENT DOCUMENTS

| | | | |
|---|---|---|---|
| 2,703,645 | 3/1955 | Scrimshaw | 206/598 |
| 4,314,390 | 2/1982 | Darby et al. | 27/35 |
| 4,320,562 | 3/1982 | Kelley | 27/2 |
| 4,800,631 | 1/1989 | Pellmann | 27/7 |
| 5,245,733 | 9/1993 | Goua | 27/35 |
| 5,261,199 | 11/1993 | Schmidt | 27/35 X |

OTHER PUBLICATIONS 3 pg. Advertisement, "Concept Caskets . . . Quality, Concern Involvement".

*Primary Examiner*—Kien T. Nguyen

*Attorney, Agent, or Firm*—William Weigl

[57] ABSTRACT

An environmentally-protective body container comprises a burnable double-walled utility case which can be used either as a shipping container and/or as a casket for burial or for cremation. The case is blow-molded from an organic thermoplastic which does not create explosive gases during burning and which leaves little ash or residue. At least the outer walls of the case are impervious to liquids, thereby preventing body and embalming fluids from contaminating the adjacent ground water supply in the case of burial. Air injection holes created in the inner walls during the conventional blow-molding process make the inner walls air pervious and thereby provide expansion space for body gases between the inner and outer walls. Use of a double-walled case also enables hand recesses to be formed into the lower section of the case and thereby eliminate the need for costly metallic pallbearing hardware. Forklift truck recesses are conveniently molded into the bottom of the case to enable lifting and handling of the case while at least its top, sides and ends are surrounded by a corrugated air tray.

13 Claims, 2 Drawing Sheets

FIG 5
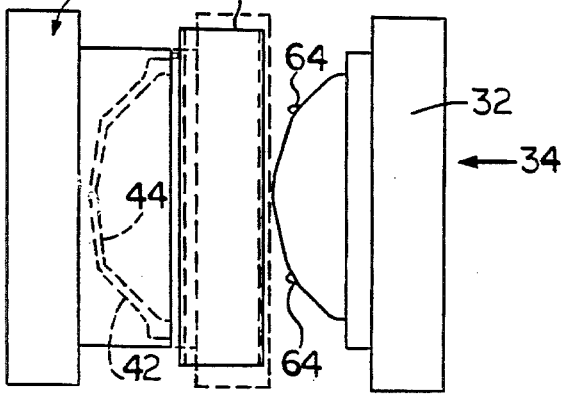
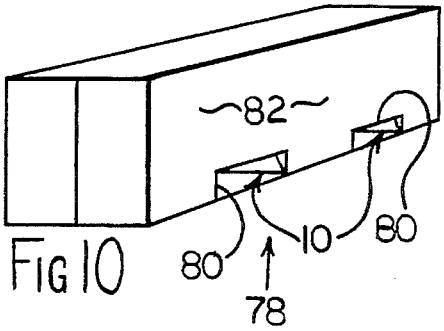
FIG 10
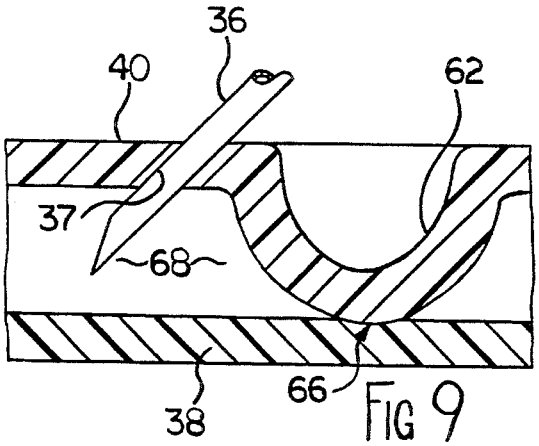
FIG 9
FIG 8
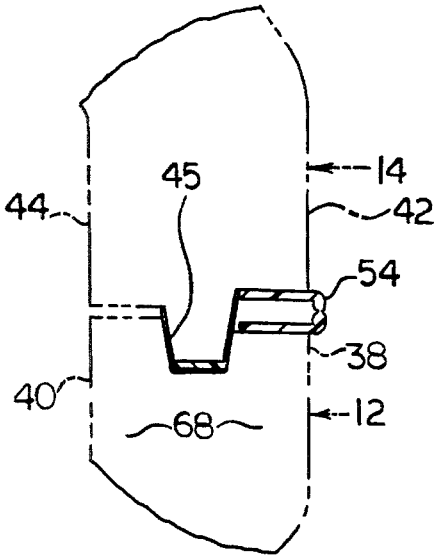
FIG 7
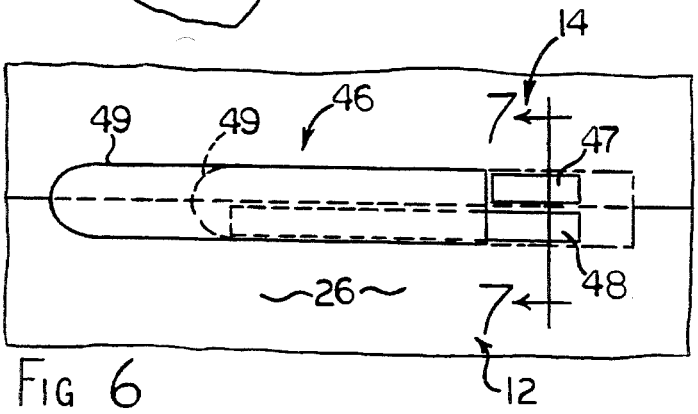
FIG 6
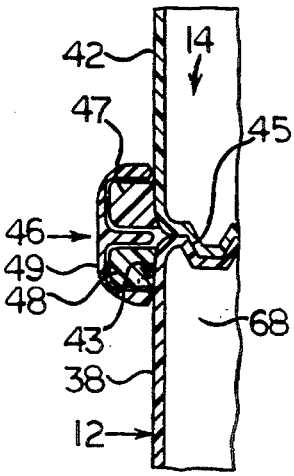

ENVIRONMENTALLY-PROTECTIVE COMBINATION BURIAL/SHIPPING/CREMATION CASE

This invention relates generally to a utility case suitable for containing a corpse for viewing and either burial or cremation. It can also be used for body shipment, thereby avoiding transfer of the body to a different type of container upon arrival at the shipping destination. In particular, the materials from which the case is made are compatible with the environment, and are economical and light in weight without sacrificing structural integrity of the case.

BACKGROUND OF THE INVENTION

Depending on the desires and finances of the family of a person who has passed away at a location far from the final burial place or body viewing location, a corpse often requires several handlings after death. This could occur, for example, if death occurs in one location, the body is placed in a temporary container, quickly shipped by air to a funeral parlor for embalming and viewing and is then either buried or cremated. Similar dual handling could occur if embalming takes place before shipment. If cremated, the body may be handled as many as three times after death, first when placed in a shipping container at a remote location, next when placed in the coffin for viewing and lastly when removed from the coffin and made ready for cremation in the event the coffin is not burnable. A variety of circumstances can exist where one or more body handlings are required before the body reaches its final resting place. While ordinarily the family is unaware of such handlings, such knowledge would be discomforting to learn, especially if fluid leakage or damage to body parts were to occur. If the body had been subjected to an autopsy, excessive handling could be detrimental to the handlers themselves, particularly if the body is diseased. In such instances, precautionary measures may have to be taken for protection of those handling the body. Where deterioration of the body has occurred, handling must be done very carefully.

While minimal body handling is desirable, another important objective of any corpse transporting and its eventual disposal is the avoidance of fluid leakage from or into the container, whether it be during shipping or after burial. Ground water protection from chemical contamination is a distant long range problem of concern to cemetaries and the municipalities in which they are located, even where caskets are placed within concrete vaults. Some of the chemicals used in embalming can have long-lasting affects and should be retained indefinitely against seepage from the casket. Steel caskets eventually corrode and wooden caskets deteriorate. Although plastic materials for various other articles are generally felt to be detrimental to the environment because of their long-lasting effects, that ability is a distinct advantage for human burial. There is even a trend toward very costly stainless steel burial caskets. Steps are also being taken in the funeral industry to line the bottom of deteriorable caskets with liquid-impervious plastic trays to protect water supplies.

When cremating a body, it is ordinarily removed from the casket prior to cremation, especially if it is made of metal, and placed in a burnable container. In some instances, body transfer can be avoided if the casket is made of burnable materials. However, any metallic hardware should be removed before cremation.

SUMMARY OF THE INVENTION

An environmentally-protective body container comprises a utility case section made by the process of blow-molding an extruded thermo-plastic parison into double-walled barriers comprising an inner shell and an outer jacket for purposes of economy, light weight and adequate structural integrity. Preferably, both the lower section and the upper section or lid of the cases are blow-molded, either as separate sections subsequently joined by an extruded plastic hinge or as a single unit with the hinge being formed during the blow-molding process. The case can be used either as a casket for burial or for cremation. The same case can also be used as a body shipping container, eliminating the need for body handling where a corpse is placed in the case at one location and then shipped by air and viewed in another location. The lid may be full of half-couch to enable viewing either the entire body or only the upper torso. By selecting an organic thermoplastic which does not create explosive gases during burning and by avoiding use of metallic hardware, the entire case and corpse can be cremated together, leaving little ash or residue. At least the lower portion of the outer jacket of the case is impervious to liquids, thereby preventing body and embalming fluids from contaminating the adjacent ground water supply in the case of burial. The impervious outer jacket also prevents outward leakage of fluids during shipment. Preferably, the outer jackets of both sections are fully impervious to prevent liquids from either leaving or entering the case at any time. Air injection holes created in the inner shells during the conventional blow-molding process serve a useful purpose in making the inner shell air pervious and thereby providing expansion space for body gases between the jackets and shells. The air injection holes may be enlarged from their production size or additional holes may be provided to enable placement of desiccants or other functional materials between the spaced walls of the case. Use of a double-walled case also enables several other advantages to be achieved. It allows hand recesses to be formed into the outer jacket and thereby eliminate the need for costly metallic pallbearing hardware. It also allows forklift truck recesses to be formed in the outer jacket bottom to provide for easier handling by airlines. The forklift recesses are convenient for strapping an air tray to the case. All of these advantages are achievable while maintaining wall thickness uniformity and the resultant minimal use of thermoplastic material inherent in the process of blow-molding.

It is a principal object of my invention to provide a utility case usable either as a shipping container, a burial casket or a cremation container, thereby eliminating body handling where the same case serves more than one of those functions.

Another object of the invention is to provide a blow-molded utility case of relatively low cost while providing a case having adequate structural integrity.

A further object is to provide a utility case which is made of material which is compatible with the environment not only in preventing leakage of fluids therefrom or thereinto, but also in being burnable without creation of explosive gases if cremated.

Yet another object is to provide a double-walled utility case which has liquid impervious exterior and an air pervious interior to provide for gas expansion space between the walls. Related to this objective, the expansion space can also be made to contain desiccant or other material to absorb gases or liquids resulting from decomposition.

Still another object is to provide a utility case capable of being lifted and handled by means of a forklift truck, in combination with a corrugated container capable of accommodating such lifting and handling.

Other objects and advantages will become apparent from the following description, in which reference is made to the accompanying drawings.

BRIEF DESCRIPTION OF THE DRAWINGS

FIG. 5 is a simplified view of blow-molding equipment which may be used to produce a preferred form of my invention.

FIG. 6 is an enlarged view of a preferred type of lock for the case within dot-dash circle 6 of FIG. 2.

FIG. 7 is a cross-sectional view of the lock of FIG. 6, taken looking along lines 7—7 of FIG. 6.

FIG. 8 is a view of an extruded hinge within dot-dash circle 8 of FIG. 3.

FIG. 9 is an enlarged fragmentary view of a stand-off used to add structural integrity to the case, as shown within the dot-dash circle 9 of FIG. 3.

FIG. 10 is a simplified isometric view of one form of shipping container for the case.

DESCRIPTION OF THE PREFERRED EMBODIMENT

Figure 1:
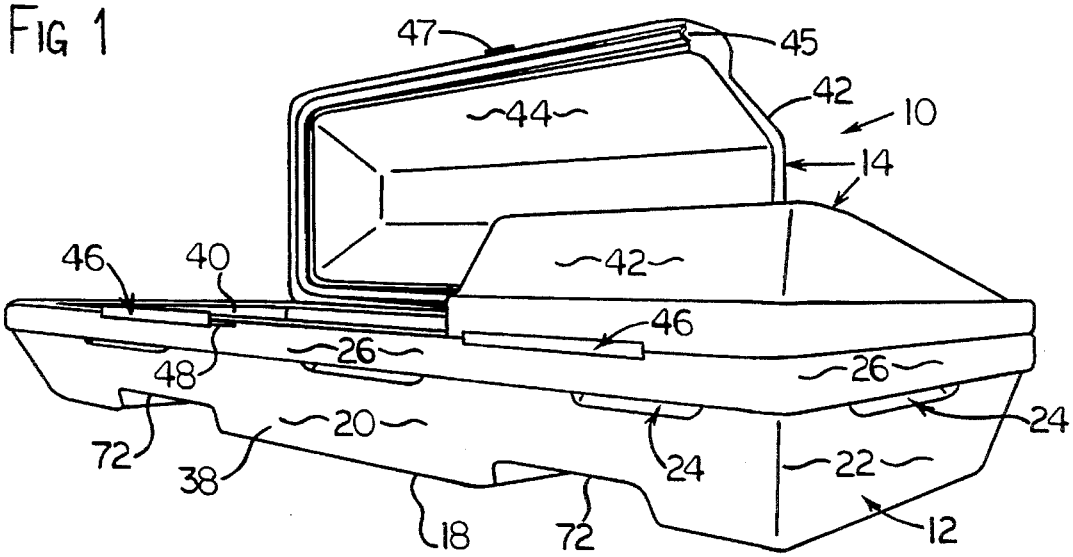
FIG. 1 is an isometric view of the case taken primarily from the front or body viewing side, showing a version of my invention in which one half of the lid is open and the other half is closed, commonly called a half-couch.
Figure 2:
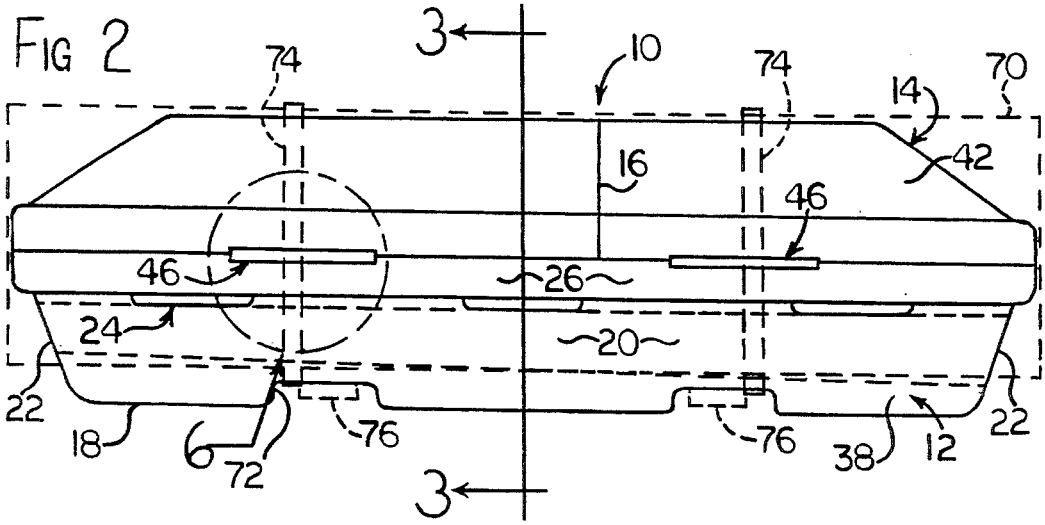
FIG. 2 is a front side elevational view of a preferred design of the utility case, illustrating its use as a shipping container.

A polyethylene utility case 10 shown in FIG. 1 includes a lower section 12 and an upper section or lid 14. The upper section 14 illustrated is customarily termed a "half-couch", i.e., it is formed as two separate portions, only one of which is intended to be opened when viewing the body. A parting line 16 shown in FIG. 2 is generally offset from center to enable the longer portion of the lid 14 to be opened for viewing all but the legs of the deceased. This parting line 16 becomes a conventional sealed joint when the case is half-couch. The line 16 would not be visible from the exterior of the lid 14 if the case is produced as full couch. In that instance, mold inserts would be used to produce a unitary lid without the seam. Since use of such inserts is commonly understood in the plastic molding industry, and since development of an appropriate seal along the parting line 16 is not pertinent to a complete understanding of the present invention, suffice it to say that the upper section or lid 14 may be either full or half couch.

The lower section 12 includes horizontal and vertical barriers consisting of a bottom wall 18, a pair of opposed side walls 20 and a pair of opposed end walls 22. Only one side wall 20 and one end wall 22 can be seen in FIG. 1.

A plurality of inwardly-directed hand recesses 24 are formed around the case 10 into side walls 20 and end walls 22 for placement of the hands of pallbearers into the recesses 24 for lifting or hand-carrying the case. If desired, the recesses may be formed continuously as a single recess around the entire lower section 12, enabling the pallbearers to position their hands along the sides as desired for best distribution of weight depending on the ability of the pallbearers to support the load. The recesses 24 are formed just below an outwardly-directed rail or ledge 26 located at the upper peripheral area of the lower section 12.

At least the lower section 12, and preferably both the lower section 12 and upper section 14, are formed from a family of high-density polyethylene thermoplastic material which is initially extruded in a heated plastic state into a tubular parison 28. See FIG. 5, which illustrates the blow-molding process in a very simplified fashion. The flexible parison 28 is positioned between opposing mold sections 30 and 32 of conventional blow-molding equipment 34, pinched off at the top and bottom, and injected with pressurized air through at least one needle 36. As is well appreciated in the art of blow-molding of plastics, the walls of the parison 28 expand and cause it to take the shape of the molding surfaces of mold sections 30 and 32. For best aesthetics, these surfaces are textured to give the exterior of case 10 a pleasing appearance. The material color is optional, being that which is best suited to the needs of the funeral industry. As shown in dotted lines in FIG. 5, the mold sections 30 and 32 are brought together and convert the section of the parison captured between the sections 30 and 32 into a hollow, double-walled structure which is a significant feature of the invention.

Referring back now to FIG. 3, the double-walled structure formed by the blow-molding equipment 34 of FIG. 5 is very simply shown as an outer jacket 38 and an inner shell 40 of the lower section 12, and an outer jacket 42 and an inner shell 44 of the upper section or lid 14. During blow-molding, the air injection needle 36 enters through inner shells 40 and 44. When the sections have cooled and solidified and the needles 36 have been withdrawn, holes 37 (FIG. 9) remain in the inner jackets where the needles were. These holes 37 are utilized for purposes to be described later.

The preferred material at the present time for the utility case 10 is a high-density polyethylene. It was this type of material which enabled the blow-molding process to achieve significant industry strides in the mid 1950's in the manufacture of bleach and detergent bottles. The liquid imperviousness of the high density polyethylene makes it quite suitable for burial use, avoiding leakage of body and embalming fluids into the ground water supply in areas around cemetaries. The plastic also keeps ground water out of the casket, giving added mental comfort to survivors of the deceased. All of this assumes that appropriate long-lasted seals are provided between the upper and lower sections and between the separate portions of the upper section in the case of a half-couch design. Such seals can be separately formed of thermoplastic materials, ordinarily extruded, or can be integrally formed during the blow-molding process. In addition, the lower section 12 and upper section 14 are hinged together in conventional fashion along one side edge of the case 10. This hinge can be separately formed of a polyethylene material and bonded to the sections 12 and 14, or can be integrally formed if the sections 12 and 14 are simultaneously molded from a single parison 28 or a pair of side-by-side parisons. Because of the size of the case for adults, twenty-six inches wide by eighty inches long to accommodate even an oversized body, I prefer to form the lower section 12 and lid 14 separately, then subsequently hinge and seal them with materials similar to the case material. The case 10 is approximately two inches wider and one inch longer than standard caskets used in the U.S.

Figure 3:
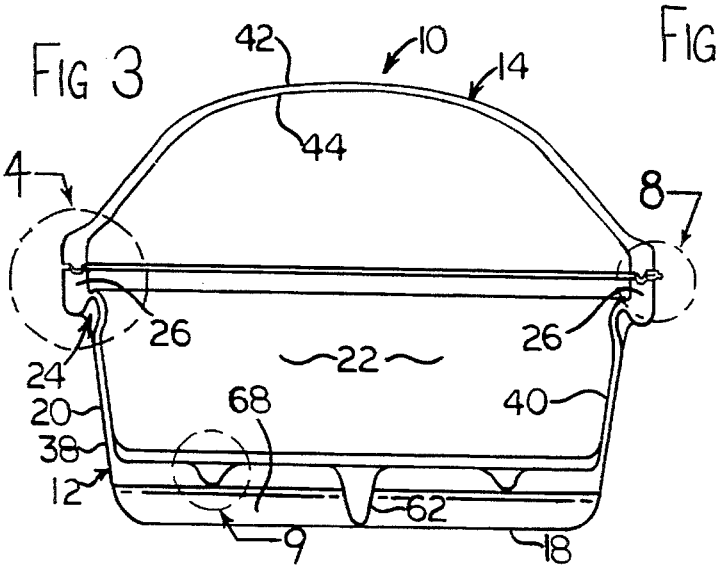
FIG. 3 is a vertical cross-sectional view of the case taken substantially along lines 3—3 of FIG. 2.
Figure 4:
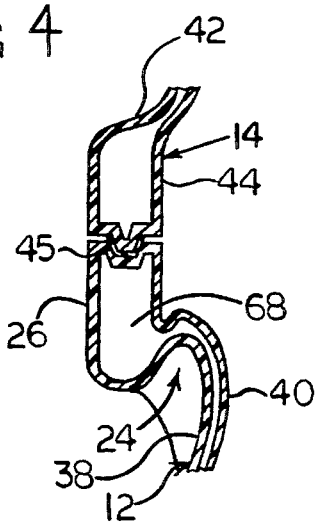
FIG. 4 is an enlarged fragmentary view of a portion of the case within the dot-dash circle 4 of FIG. 3.

FIG. 4 is an enlarged illustration of the area of FIG. 3 within the dot-dash circle 4. It further illustrates one type of resilient seal 45 which may be used between the lower section 12 and the lid 14.

FIGS. 6 and 7 show details of a locking mechanism 46, FIG. 6 being an enlarged frontal view of the elements within dot-dash circle 6 of FIG. 2 and FIG. 7 being a further enlarged cross-sectional view taken along lines 7—7 of FIG. 6. Either integrally formed on the exterior of the lid 14 and lower section 12, or separately produced and cemented thereon are upper and lower bosses 47 and 48, respectively. As seen, boss 48 is long and boss 47 is short. A capturing slide 49 is horizontally movable from its solid line position to its dotted line position in FIG. 6. When in the solid line position, the locking mechanism 46 is unlatched and the lid 14 is free to be raised and lowered. When moved to the dotted line position, the boss 47 is captured within a groove in slide 49 and the lid 14 is locked against the lower section 12. As the slide 49 is moved rightwardly, the bosses 47 and 48 are cammed toward each other in conventional fashion with sufficient force to compress seal 45 and make the case 10 airtight.

Slide 49 is provided with and typical guide and way system 43 to retain slide 49 attached to boss 48 whether the casket is open or closed. Since the particular locking mechanism is a matter of choice, further details have been omitted from the description.

FIG. 8 illustrates one type of hinge 54 which may be used between the sections 12 and 14 to enable the lid 14 to be moved between its open and closed positions. The hinge 54 can be extruded separately and bonded to the adjoining ledges at one side wall of the case, or can be a living hinge if produced in the molding equipment along with the sections 12 and 14 as a unitary case. If made separately, the hinge 54 and seal 45 can be made integral.

FIG. 9 is an enlarged section of a jacket 38 and shell 40 structurally strengthened by means of a stand-off 62. This Figure is of the portion within the dot-dash circle 9 of FIG. 3. Also illustrated in FIG. 9 is an injection needle 36, which in actuality may be inserted anywhere and in several different positions through what is to become inner shell 40, to expand the parison 28 and force its outer surface against the molding surfaces of the mold sections 30 and 32. The parison is in a heated state at the time a number of such stand-offs 62 are formed between the outer jackets and inner shells. Conventional protrusions 64 (FIG. 5) are provided in the mold section 32. When mold sections 30 and 32 are brought together, the extending ends of protrusions 64 are spaced from mold section 30 less than twice the thickness of the walls of the parison 28. This effects a fusing pressure at point 66, welding the ends of the stand-offs 62 to the inside surface of jacket 38. An air space 68 is thus created between the outer jackets and inner shells. The stand-offs 62 create fixing bridges between the jackets and shells, adding structural integrity to the sections 12 and 14. The structural integrity inherent in the blow-molding process gives me a low cost light weight case 10. Lower weight is the result of using less material because of the thinner double walls. Lower cost is a result of the reduced amount of material required, lower shipping expenses and the design advantages inherent when using blow-molded structures.

The choice of high-density polyethylene enables the case and its contents to be cremated without atmospheric damage any more severe than air pollution from burning oil or other hydrocarbons. The selected material should be one which does not produce explosive gases and which results in minimal ash during combustion. I do not wish to limit the broadest aspects of my invention to the particular material I presently find to best suit the industry's and environment's needs. If the case 10 is produced as described, I can completely eliminate the need for metallic hardware such as the extra pallbearer handles or rails, hinges, locking mechanisms, etc. This simplifies the cremation process, which either requires removing the hardware or its being rendered useless if burned and separated from the ashes after creation.

The final disposal of the deceased by burial or cremation having been discribed, let us now return to FIG. 2 and consider the same utility case 10 used as a shipping container. If the casket is to be shipped via a passenger aircraft, most airlines will seek to disguise it by placing an inverted half-box 70 over the top, sides and ends of the container. This is commonly termed an "air tray". Not only does the air tray provide some protection against casket damage, but it keeps passengers from seeing the casket being placed on board. Some individuals, especially those who dislike flying in the first instance or who may be superstitious, might feel uneasy having a corpse traveling with them to their destination.

The utility case of my invention nicely accepts such an air tray half-box 70, as shown in dotted lines. Air tray 70 depends downwardly approximately to the upper level of upwardly- directed lateral recesses 72 formed in the outer jacket 38. Strapping 74, preferably of burnable plastic, maintains the air tray 70 intact over the case 10 during shipment. By being burnable, if cremation occurs at the shipping destination without any viewing, the container can be cremated without removal of air tray 70 or strapping 74, if desired. Recesses 72 are also provided for forklift truck handling at the airport, if necessary. Tines 76 of a forklift truck are shown in dotted lines in FIG. 2. Recesses are wide enough between the ends of the case 10 to accommodate differently spaced forklift tines. The portions or legs of the bottom wall 18 outwardly of the recesses 72 have sufficient area to enable belt conveyance of the case 10 to and from the cargo bay of an aircraft.

An alternate type of air tray 78 is depicted in FIG. 10. In respect of eliminating the need for the strapping 74, it has certain advantages over the half-box of FIG. 2. In this version, a pair of openings 80 are provided in each elongated side 82 of the air tray 78. The openings 80 are in alignment with lateral recesses in case 10 and, together with the recesses, accommodate the tines 76 of a forklift truck.

If desired, the blow-molding process of producing the case 10 allows me to conform the bottom wall 18 of the inner shell 40 to the general shape of a reclining corpse, or to merely slightly incline the bottom from the head end of the case toward the foot end. For simplicity, I prefer to do the latter. Either of these eliminates the cost of a standard bed system. If the body is to be viewed after air shipment, a pillow designed according to one teaching of my co-pending U.S. patent application Ser. No. 08/045,653, filed Apr. 9, 1993 may be utilized. The pillow would be placed in the case before the body. The pillow should have both its central and surrounding sections inflatable. They would be deflated during shipment and inflated, again without handling the body, prior to viewing. The pillow function would be to adjust the chin-to-chest relaxed appearance of the deceased for viewing.

What has been described to this point should indicate very clearly that I have achieved a utility case which can serve for either burial or cremation. It can further serve as a shipping container, regardless of whether it is to be ultimately buried or cremated. This multiple use allows the same case 10 to initially receive the body, be shipped, allow for viewing, and either be buried beneath the earth or cremated, all without requiring further body handling by taking it from one container and placing it in another. In the instance where the special pillow of my copending patent application is also used, the head repositioning is done without even touching the body. By avoiding body handling after its initial placement in the case 10, the advantages of refraining from such handling is obvious.

In some countries, closed-casket viewing is provided by placing a window in the lid above the face of the deceased. This can be readily accomplished when using the blow-molding process according to my invention by forming an edge-sealed opening in the lid 14 and placing a window therein.

Although the outer jackets 38 and 42 of the lower section 12 and lid 14, respectively, are liquid impervious throughout, it would be considered within the scope of the claimed subject matter if only the lower section (or the lowermost portion of the lower section) was made liquid impervious. This would advantageously prevent outward liquid seepage during shipment and after burial, but, under certain circumstances would still allow liquid entrance through the lid. The preferred form of the invention is to have both sections 12 and 14 liquid impervious at their exteriors.

Because the barriers or walls 18, 20 and 22 are created as a double-walled structure via the blow-molding process, the inner shells 40 and 44 are inherently air pervious at completion of the molding. This is due to the use of the air injection needles 36 to expand the parisons 28 against the molding surfaces of the equipment 34. This air perviousness provides the space 68 between the double walls to allow for expansion of body and chemical gases. The air injection holes 37 created by needles 36 can be enlarged or additional holes made in the inner shells 40 and 44 to allow for placement of materials in the space 68 between the walls. For example, odor-absorbing desiccants may be used. Floral or other odor-producing materials, either liquid, granular or solid, can be positioned within the space. Solid carbon dioxide, commonly called "dry ice", may also be placed within the space for coolant purposes.

While I prefer that both the lower section 12 and the lid 14 be blow-molded, either one may be made by another process. The lower section may be made according to my U.S. Pat. No. 5,121,529, for example.

Various other changes may be made without departing from the spirit and scope of the claims.

Having described my invention, I claim:

1. In a corpse-containing utility case, a generally-rectangular lower section comprising an elongated horizontal bottom barrier, a pair of opposed side barriers extending vertically upward from opposite side edges of said bottom barrier and a pair of opposed end barriers extending vertically upward from opposite end edges of said bottom barrier; all of said sid barriers and end barriers being essentially of the same height and forming a horizontal upper edge around said lower section of said case; and a generally-rectangular lid for enclosing and sealing the upper edge of said lower section; the improvement comprising:

said lower section having a unitary liquid-impervious outer jacket and a unitary air-pervious shell located inwardly of said outer jacket and providing a space between said shell and said jacket, said shell and said outer jacket being joined around the upper edges of said side barriers and said end barriers to thereby form an integral double-walled lower section of said case.

2. A corpse-containing case according to claim 1 wherein said air-pervious shell is provided with openings to allow for gas expansion from inside said shell into said space when said lid is sealed stop said lower section.

3. A corpse-containing case according to claim 1 wherein said outer jacket and said shell are formed from a blow-molded parison of extruded thermoplastic material, and wherein said shell is provided with a plurality of stand-offs for maintaining said jacket and shell in their spaced-apart relation.

4. A corpse-containing case according to claim 3 wherein said lid is also produce by blow-molding a parison of extruded thermoplastic material as a unitary outer jacket and a unitary inner shell spaced therefrom, wherein the outer peripheries of said lid jacket and shell are joined, and wherein a hinge connects one upper edge of one of said side barriers with a corresponding side edge of said lid.

5. A corpse-containing case according to claim 4 wherein a latch means is provided on said case on the upper edge of said side barrier opposite the side barrier containing said hinge, said latch means comprising at least one portion thereof on each of said lower section and said lid.

6. A corpse-containing case according to claim 5 wherein said lid is divided laterally into two separate half-couch section, each of said half-couch sections having its own outer jacket and inner shell joined about its periphery, and wherein said hinge consists of a pair of hinge portions connecting each said half-couch section to said side barrier.

7. A corpse-containing case according to claim 1 wherein said entire case is produce from a family of polyethylene thermoplastic materials suitable for cremation of the case and corpse without creating explosive gases during the cremation and with minimal residue resulting from burning of the case.

8. A corpse-containing case according to claim 7 wherein said jacket and said shell are blow-molded from a parison of high-density polyethylene material.

9. A corpse-containing case according to claim 1 wherein said shell is provided with at least one opening therethrough, and wherein a desiccant is placed into said space between said jacket and shell through said opening.

10. A corpse-containing case according to claim 1 wherein said shell is provided with at least one opening therethrough, and wherein a cooling medium is placed into said space between said jacket and shell through said opening.

11. A combination case usable as any of a burial casket, body shipping container or cremation container for a corpse, said case comprising a generally-rectangular body-containing lower section having an elongated horizontal bottom barrier, a pair of opposed side barriers extending vertically upward from opposite side edges of said bottom barrier, and a pair of opposed end barriers extending vertically upward from opposite end edges of said bottom barrier; all of said side barriers and end barriers being essentially of the same height and forming a horizontal upper sealing edge; and a generally-rectangular lid for enclosing and sealing with the upper edge of said lower section, the improvement comprising:

The lower section and the lid of said case each consisting of a liquid-impervious unitary outer jacket and an air-impervious inner shell formed from a blow-molded parison of thermoplastic material to thereby provide an open air space between each associated said shell and said jacket, the shell and outer jacket of said lower section being joined at their upper edges to enclose said open air space in said lower section and the shell and outer jacket of said lid being joined at their outer lower edges to enclose said open air space in said lid, thereby forming said case into an integral double-walled blow-molded lower section and an integral double-walled blow-molded lid.

12. A combination case according to claim 11 wherein said lower section shell is provided with at least one opening therethrough, and wherein a desiccant is placed into said space between said lower section shell and jacket through said opening.

13. A combination case according to claim 11 wherein the bottom of said outer jacket of said lower section is provided with spaced, upwardly-directed lateral recesses extending across said case, the vertical depth of said recesses being of a dimension capable of accommodating lifting the case by means of the tines of a forklift truck, and wherein there is further provided a corrugated cardboard container having a top, opposing elongated side, opposing ends an open bottom, the inner dimensions of said top, ends and sides enabling fitting of the container over the case from above, means for strapping said container over the case for covering the top, sides and ends of the case during shipment, and a pair of openings in each elongated side of said container adjacent the open bottom thereof, said openings being in through-alignment with said lateral recesses in said case, whereby, when said covered case is transported by a forklift truck, its tines may pass into said openings on one side of said container, through said lateral recesses in said case and out of said openings on the opposite container side.

* * * * *

UNITED STATES PATENT AND TRADEMARK OFFICE

CERTIFICATE OF CORRECTION

PATENT NO. : 5,485,661

DATED : January 23, 1996

INVENTOR(S) : WILBUR F. MCCLURE

It is certified that error appears in the above-identified patent and that said Letters Patent is hereby corrected as shown below:

Column 7, line 52, "sid" should be: -- side --.

Column 7, line 67, "stop" should be: -- atop --.

Column 8,line 8, "produce" should be: --produced --.

Column 8, line 18, back reference numeral "5" should be: --4 --.

Column 8, line 25, "produce" should be: -- produced --.

Column 8, line 57, "air-impervious" should be: -- air-pervious--.

Column 9, line 13, "side" sh ould be: -- sides --. Same line, after "ends", add: -- and--.

Signed and Sealed this

First Day of October, 1996

Bruce Lehman

*Attest:*

BRUCE LEHMAN

*Attesting Officer*

*Commissioner of Patents and Trademarks*